US012702188B1

(12) United States Patent
Ng

(10) Patent No.: US 12,702,188 B1
(45) Date of Patent: Aug. 11, 2026

(54) SPORTS SHOE WITH FOOT'S LITTLE TOE PROTECTION STRUCTURE

(71) Applicant: Jariel Ng, BelleVue Residences (SG)

(72) Inventor: Jariel Ng, BelleVue Residences (SG)

( * ) Notice: Subject to any disclaimer, the term of this patent is extended or adjusted under 35 U.S.C. 154(b) by 0 days.

(21) Appl. No.: 19/464,577

(22) Filed: Jan. 29, 2026

(51) Int. Cl.

| | |
|---|---|
| ***A43B 7/14*** | (2022.01) |
| ***A43B 5/06*** | (2022.01) |
| ***A43B 7/148*** | (2022.01) |
| ***A43B 7/149*** | (2022.01) |
| ***A43B 7/26*** | (2006.01) |

(52) U.S. Cl.
CPC ..... *A43B 7/148* (2013.01); *A43B 5/06* (2013.01); *A43B 7/149* (2013.01); *A43B 7/26* (2013.01)

(58) Field of Classification Search
CPC ..... A43B 7/149; A43B 7/26; A43B 7/28
USPC ..... 36/94, 95
See application file for complete search history.

(56) References Cited

U.S. PATENT DOCUMENTS

| | | | | | |
|---|---|---|---|---|---|
| 1,020,160 | A * | 3/1912 | Rowe | A43B 23/28 | 36/71 |
| 2,261,041 | A * | 10/1941 | Tennant | A43B 7/14 | 36/95 |
| 2,312,911 | A * | 3/1943 | Jewtraw | A43B 5/16 | 36/71 |
| 2,389,032 | A | 11/1945 | Donnelly | | |
| 4,583,303 | A * | 4/1986 | Laiacona | A43B 7/00 | 2/24 |
| 5,740,618 | A | 4/1998 | Minden | | |
| 6,041,524 | A * | 3/2000 | Brooks | A43B 13/41 | 36/71 |
| 9,974,354 | B1 * | 5/2018 | Irving | A43B 3/30 | |
| 2002/0020081 | A1 * | 2/2002 | Brooks | A43B 23/07 | 36/95 |
| 2018/0228247 | A1 | 8/2018 | Müller | | |
| 2025/0386896 | A1 * | 12/2025 | Shin | A43B 7/26 | |

* cited by examiner

*Primary Examiner* — Sharon M Prange
(74) *Attorney, Agent, or Firm* — Birchwood IP

(57) ABSTRACT

This utility model relates to the field of sports shoe structure, in particular to the sports shoe with foot's little toe protection structure, comprising a sole and a upper, the area of the upper corresponding to the little toe of human foot is a little toe protection area, the sole extends upwards at the corresponding part of the little toe protection area, to form a protection part covering the outer side of the little toe protection area, the protection part is a bulge which is bulging outward, whose inner side is a concave cavity that is not bonded to the upper, and the bulging edge of the protection part is bonded to the upper, a flexible structure for squeezing the foot's little toe is provided between the little toe protection area and the concave cavity.

2 Claims, 4 Drawing Sheets

SPORTS SHOE WITH FOOT'S LITTLE TOE PROTECTION STRUCTURE

TECHNICAL FIELD

The utility model relates to the field of sports shoes structure, in particular to the sports shoes with foot's toes protection structures.

BACKGROUND OF THE INVENTION

At present, sports shoe products on the market focus more on functional structural design such as wear resistance, shock absorption, cushioning, comfort, and wrapping. In terms of human foot protection, the main focus is on the design of protection structures to prevent sprains and protect ankles. However, there are still very few protection structures for the foot's toes. There is a current situation regarding the protection of the foot's toes, specifically, in adolescent sports injuries, in addition to common sprains, there are also injuries to the foot's toes, especially the foot's little toe. Due to the fact that adolescent skin is still relatively tender, running, jumping, kicking, and sudden stopping actions during exercise can cause significant squeezing force on the little toe of the foot. Some even cause redness, swelling, and skin abrasion on the foot's little toe after each exercise. Moreover, adolescents are in a stage of skeletal development, and long-term exposure to this state can also have an impact on the skeletal development of the foot's toes, leading to deformation of the foot's little toe of the foot. The deformation of the foot's little toe is also a common occurrence in many adults, which is caused by frequent squeezing from a young age. In addition, long-term squeezing also has a certain adverse effect on the growth of nails on the foot's little toe.

Although the above issues may not have the adverse effect of causing bone deformation in most people, redness, swelling, and abrasion of the little toe are quite common. Adolescents are also in a stage of being energetic and active, and foot pain and discomfort can affect their foot movements and also affect their exercise enthusiasm.

BRIEF SUMMARY OF THE INVENTION

The purpose of this utility model is to provide a sports shoe with a foot's little toe protection structure, whose toe protection structure can provide flexible contact for the foot's little toe when subjected to squeezing, thereby providing protection.

To achieve the above objectives, the technical solution of this utility model is: A sports shoe with a foot's little toe protection structure, comprising a sole and a upper bonded to said sole, the area of said upper corresponding to the little toe of human foot is a little toe protection area, said sole extends upwards at the corresponding part of the little toe protection area, to form a protection part covering the outer side of the little toe protection area, said protection part is a bulge which is bulging outward, whose inner side is a concave cavity that is not bonded to the upper, and the bulging edge of said protection part is bonded to the upper, a flexible structure for squeezing the foot's little toe is provided between said little toe protection area and the concave cavity.

Said flexible structure is that the outer side of the little toe protection area is covered with a protective thin film, the bulging edge of said protection part is bonded to the protective thin film.

Said flexible structure is that the concave cavity is embedded or filled with airbags or cushions.

The upper fabric of the little toe protection area is flexible fabric.

A protective through hole is provided in the little toe protection area of said upper, said flexible structure includes a support plate embedded in the concave cavity and a silicone block fixedly bonded to the surface of the support plate, the part of said silicone block corresponding to the protective through hole protrudes to form a protective protrusion that passes through the protective through hole and protrudes inside the upper to contact human foot's toes.

The structure of said support plate includes an inner support plate and an outer support plate with relative spacing, as well as an arc-shaped connection part formed by extending and connecting the two ends of the inner support plate and the outer support plate respectively, said outer support plate is embedded towards the concave cavity, and said silicone block is bonded and connected to the outer surface of the inner support plate.

By adopting the above technical solution, the beneficial effect of the present utility model is that the sports shoes with the above-mentioned structure are equipped with a little toe protection area on the corresponding part of the foot's little toe through the upper and a flexible structure protection area on the corresponding position of the shoe sole to provide deformable buffering when the foot's little toe is squeezed during movement, achieving flexible contact and reducing the force generated during squeezing, which can cause damage to the foot's little toe. The flexible contact can naturally improve the comfort of the foot's little toe. The functional effect of the structure can effectively solve the problems mentioned in the background and achieve the above-mentioned goal of this utility model. In addition, the above structure has a simple structure, easy to produce and implement, suitable for widespread application, stable and durable in structure, and can also be adapted for shoe applications of different age groups and usage environments.

Figure 1:
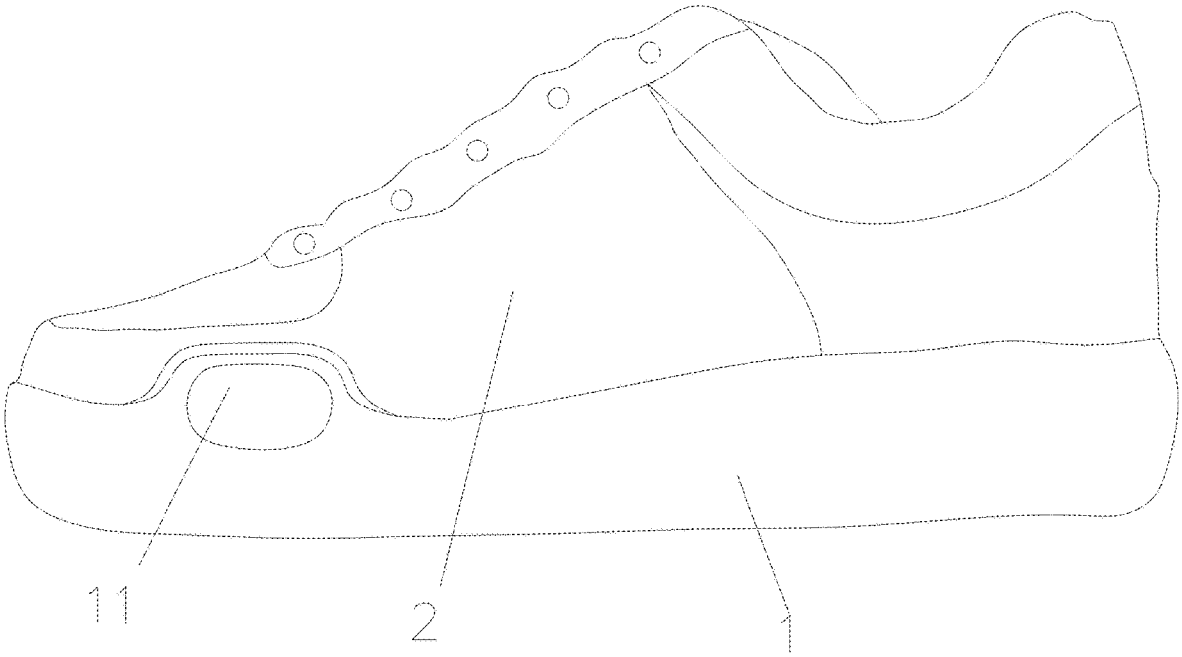
FIG. 1 is a schematic diagram of the structure of a sports shoe with a foot's little toe protection structure related to the present utility model.

Sole 1; Protection part 11; Concave cavity 12; Upper 2; Little Toe Protection Area 21; Protective through hole 22;

Flexible structure 3; Protective thin film 31; Airbags or cushions 32; Support plate 33;

Inner support plate 331; Outer support plate 332; Arc-shaped connecting part 333; Silicone block 34; Protective protrusion 341.

DETAILED DESCRIPTION OF THE INVENTION

To further explain the technical solution of the utility model, the following will provide detailed explanation of the utility model through specific embodiments.

The present utility model discloses a sports shoe with a foot's little toe protection structure, which is an improved setting on the existing shoe structure comprising a sole and an upper bonded to the sole. The following is a detailed description through embodiments combined with the accompanying drawings.

Figure 2:
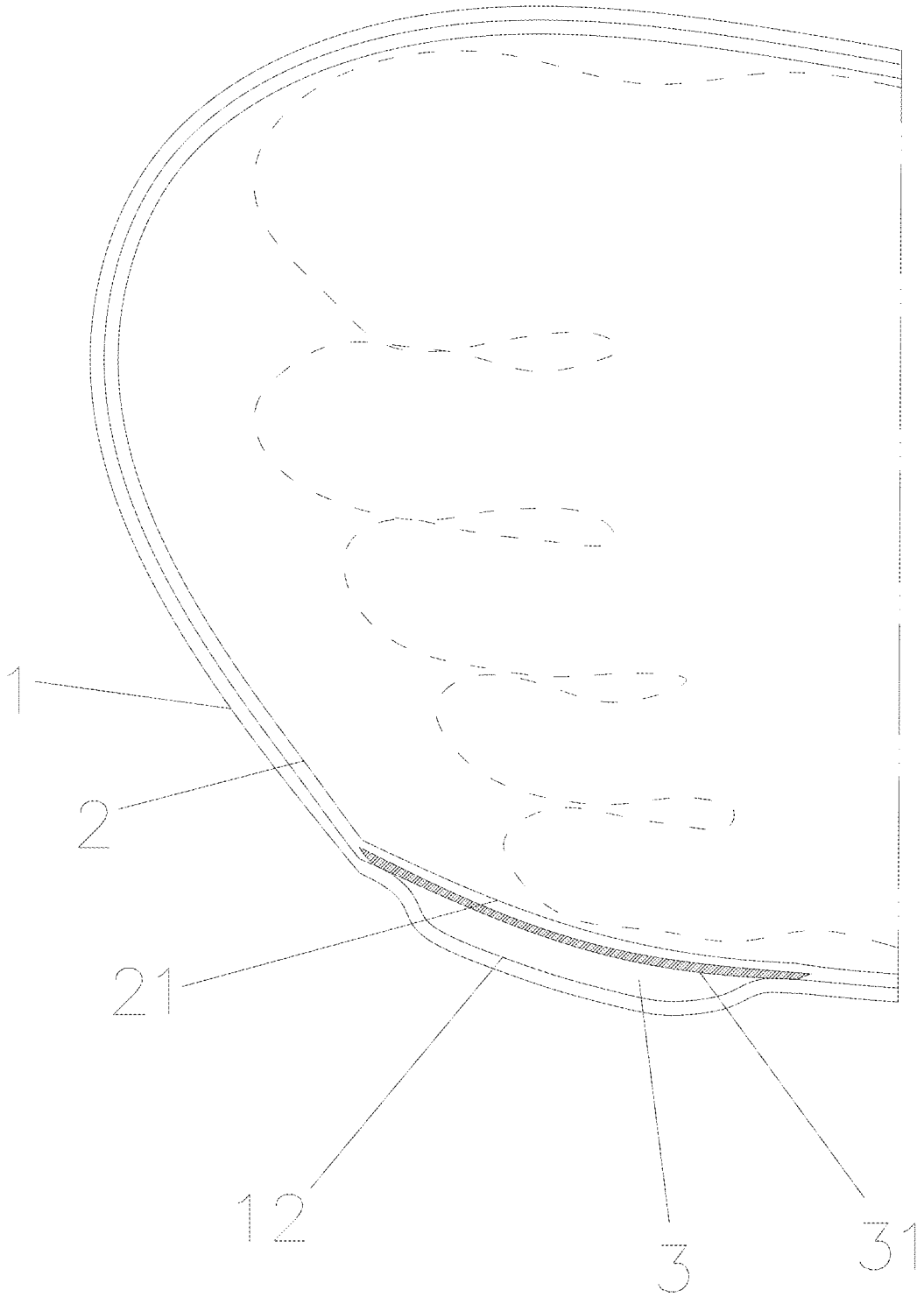
FIG. 2 is a schematic diagram of the top-down cross-sectional structure of the first embodiment of a sports shoe with a foot's little toe protection structure related to the present utility model.

Example 1, as shown in FIGS. 1 and 2, the sports shoe comprises a sole 1 and an upper 2 bonded to the sole 1. The area of the upper 2 corresponding to the little toe of human foot is a little toe protection area 21. The sole 1 extends upwards at the corresponding part of the little toe protection area 21, to form a protection part 11 covering the outer side of the little toe protection area 21. The protection part 11 is a bulge which is bulging outward, and it can be directly formed during the production and molding of the sole. For example, the commonly used foam sole can directly foam the structure of the bulging protection part 11 in the mold. In addition, the upper fabric of the little toe protection area 21 can be made of flexible fabric, such as knitted fabric or other thinner soft fabrics. The bulging inner side of the protection part 11 is a concave cavity 12 that is not bonded to the upper 2, and its bulging edge is bonded to the upper 2. A flexible structure 3 for squeezing the foot's little toe is provided between the little toe protection area 21 and the concave cavity 12. In this embodiment, the flexible structure 3 is, as shown in the figure, is a protective thin film 31, and the outer side of the little toe protection area 21 is covered with a protective thin film 31. The bulging edge of the protection part 11 is bonded to the protective thin film 31. The protective thin film 31 can be an independently produced thin film, which can be a rubber sheet or a foam sheet material. The thin film has good elastic deformation effect and can be stably bonded to the outer surface of the upper. When the little toe is squeezed to the position of the protective thin film 31, the protective thin film 31 is deformed and embedded into the concave cavity 12 under pressure. Therefore, the concave cavity 12 in this embodiment provides a space for deformation, and the protective thin film 31 forms a flexible buffering squeezing pressure, thereby protecting the foot's little toe.

Figure 3:
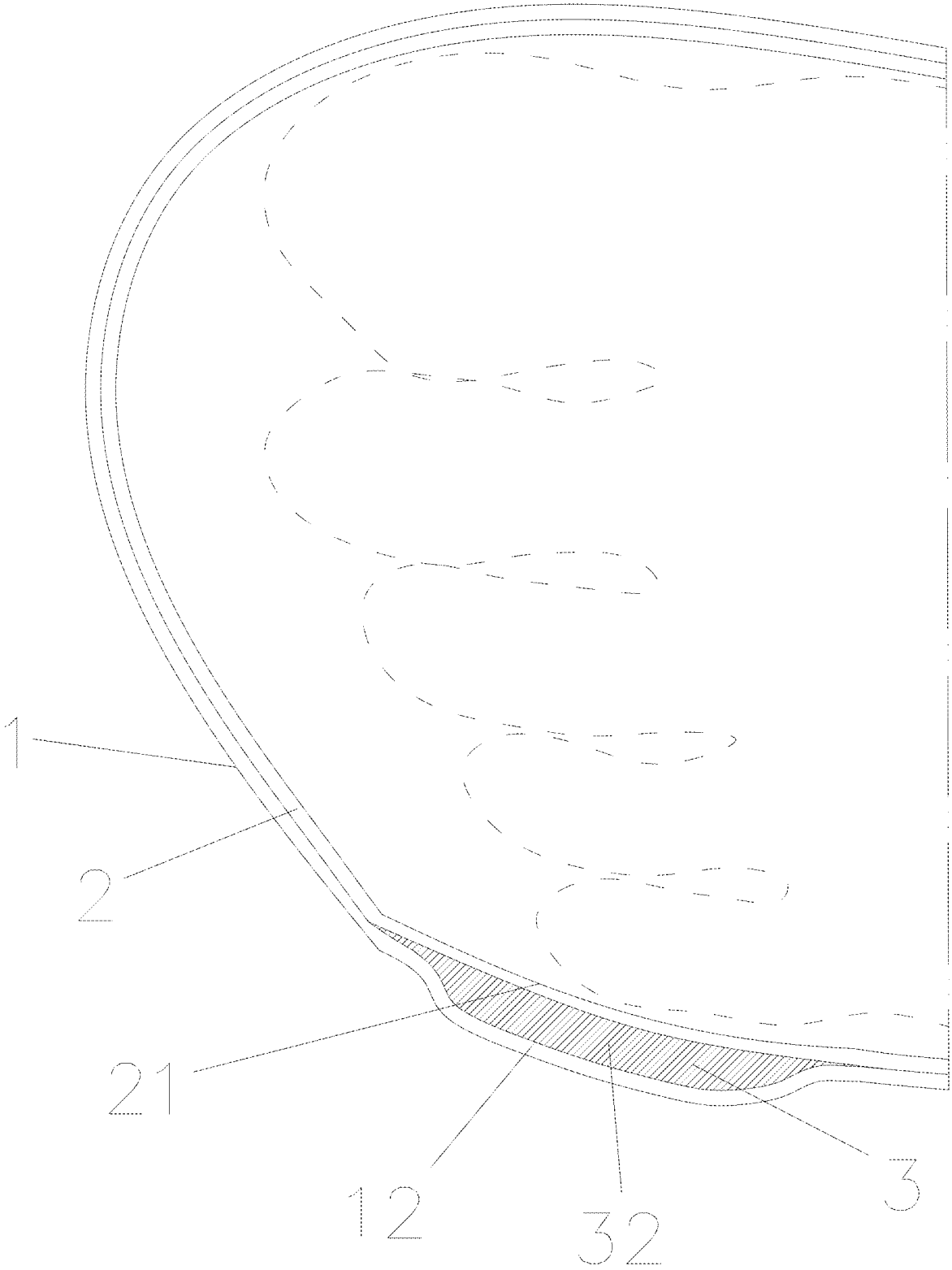
FIG. 3 is a schematic diagram of the partial cross-sectional structure of a second embodiment of a sports shoe with a foot's little toe protection structure related to the present utility model.

Example 2, as shown in FIG. 3, differs from Example 1 in that the flexible structure 3 is not equipped with a protective sheet 31, but is embedded or filled with airbags or cushions 32 in the concave cavity 12. Through the airbags or cushions 32, the elastic deformation of the protective sheet 31 in Example 1 is achieved, and the effect of flexible support is achieved.

Figure 4:
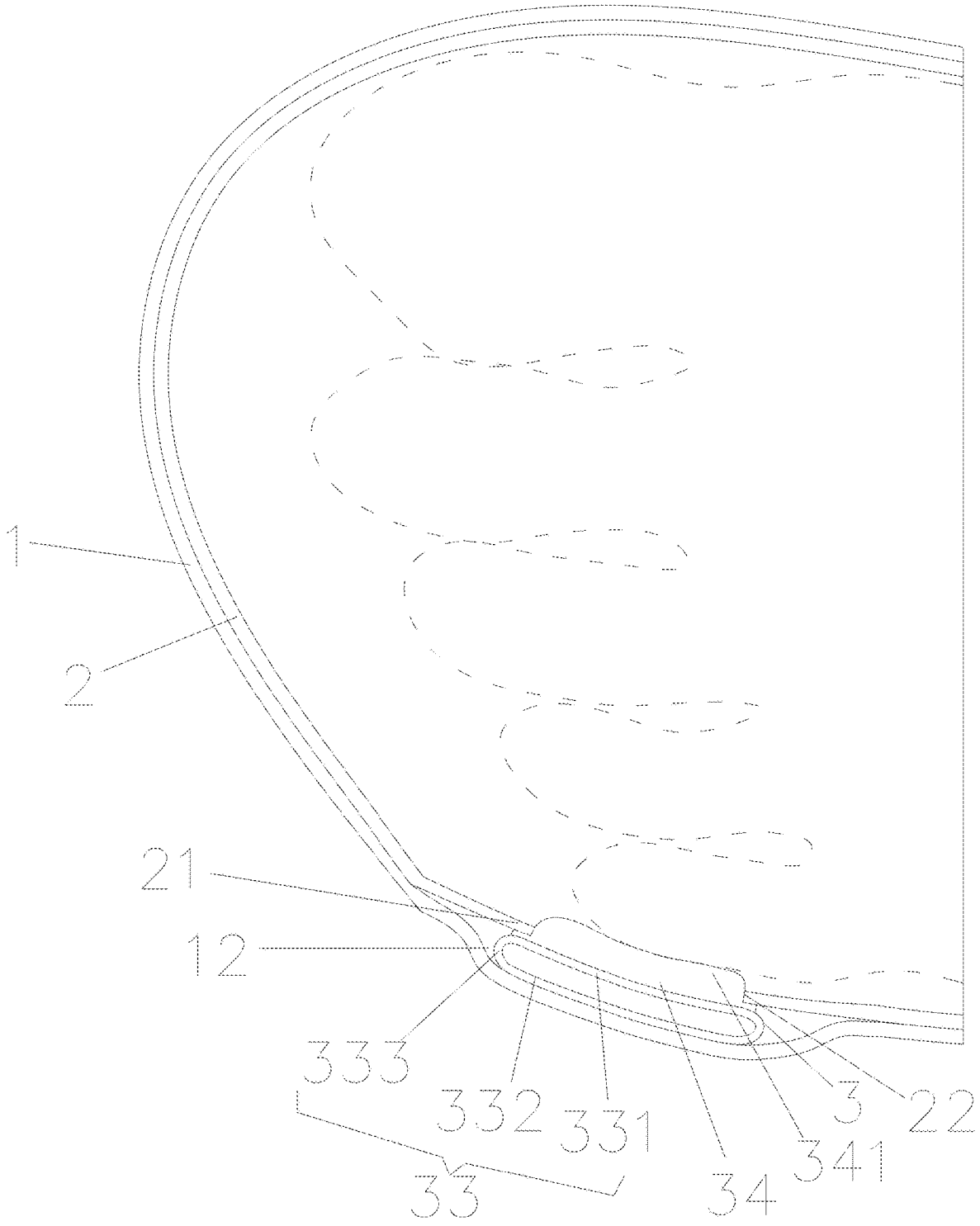
FIG. 4 is a schematic diagram of the partial cross-sectional structure of a third embodiment of a sports shoe with a foot's little toe protection structure related to the present utility model.

Example 3, as shown in FIG. 4, the sports shoe include a sole 1 and a upper 2 bonded to the sole 1. The area corresponding to the little toe of human foot on the upper 2 is a little toe protection area 21. The sole 1 extends upwards at the corresponding part of the little toe protection area 21, to form a protection part 11 covering the outer side of the little toe protection area 21. The protection part 11 is a bulge which is bulging outward, and it can be directly formed during the production and molding of the sole. For example, the commonly used foam sole can directly foam the structure of the bulging protection part 11 in the mold. The bulging inner side of the protection part 11 is a concave cavity 12 that is not bonded to the upper 2, and its bulging edge is bonded to the upper 2. A flexible structure 3 for squeezing the foot's little toe is provided between the little toe protection area 21 and the concave cavity 12. Unlike the above embodiments, in this embodiment, a protective through hole 22 is provided in the little toe protection area 21 of the upper 1. The flexible structure 3 in this embodiment, as shown in the figure, includes a support plate 33 embedded in the concave cavity 12 and a silicone block 34 fixedly bonded to the surface of the support plate 33. The part of the silicone block 34 corresponding to the protective through hole 22 protrudes to form a protective protrusion 341 that passes through the protective through hole 22 and protrudes inside the upper 1 to contact the little toe of human foot. The silicone block 34 has a relatively soft characteristic, and when the little toe is squeezed into the little toe protection area 21, it directly presses against the soft protective protrusion 341, so it can also effectively protect the little toe. Due to the soft and deformable characteristic of silicone material, the main function of the support plate 33 here is to provide support for the shaping, positioning, and connection of the silicone block 34, so that the silicone block 34 will not deviate from its position and can maintain structural stability. In addition, in order to further enhance the flexible protective support in situations with high squeezing pressure in this embodiment, the structure of the support plate 33 can be further set as shown in the figure, including the inner support plate 331 and the outer support plate 332 with relative spacing, as well as the arc-shaped connection part 333 formed by extending and connecting the two ends of the inner support plate 331 and the outer support plate 332 respectively. The outer support plate 332 is embedded towards the concave cavity 12, and the silicone block 34 is bonded and connected to the outer surface of the inner support plate 331. The protective protrusion 341 passes through the corresponding protective through hole 22 and protruding inside the upper 1, providing flexible contact for the foot's little toe. Also, the support plate 33 of the above structure has a circular structure as a whole, which can be directly injection molded with plastic. The plastic ring can be deformed and compressed and elastic recovered when squeezed, therefore, it can also achieve elastic support and better achieve flexible support.

The above embodiments and drawings do not limit the product form and style of the present utility model. Any appropriate changes or modifications made by ordinary technical personnel in the technical field shall be deemed not to be outside the scope of the present utility model patent.

The invention claimed is:

1. A sports shoe with a little toe protection structure, comprising a sole and an upper bonded to said sole, wherein an area of said upper corresponding to a little toe is a little toe protection area, a portion of said sole corresponding to the little toe protection area extends upwards to form a protection part covering an outer side of the little toe protection area, said protection part is a bulge which bulges outwards, an inner side surface of the bulge is a concave cavity that is not bonded to the upper, and an edge of the bulge is bonded to the upper, a flexible structure configured to press against the little toe is provided between said little toe protection area and the concave cavity; a through hole is provided on the little toe protection area of said upper, said flexible structure includes a support plate embedded in the concave cavity and a silicone block fixedly bonded to one surface of the support plate, a portion of said silicone block corresponding to the through hole protrudes out of the through hole to form a protective protrusion that extends into an interior side of the upper; the protective protrusion is configured to be in contact with the little toe.

2. A sports shoe with a foot's little toe protection structure as claimed in claim 1, wherein the support plate includes an inner support plate and an outer support plate spaced apart from each other, as well as an arc-shaped connection part formed by extending and connecting each pair of corresponding ends of the inner support plate and the outer support plate respectively, said outer support plate is embedded in the concave cavity, and said silicone block is bonded and connected to an outer surface of the inner support plate.

* * * * *